US007347501B2

(12) United States Patent
Bettermann et al.

(10) Patent No.: US 7,347,501 B2
(45) Date of Patent: Mar. 25, 2008

(54) PLOW BASEPLATE

(75) Inventors: Diedrich Bettermann, Unna (DE); Klaus Duhnke, Bochum (DE); Norbert Hesse, Bochum (DE); Gerhard Siepenkort, Lünen (DE); Adam Klabisch, Dortmund (DE)

(73) Assignee: DBT GmbH (DE)

( * ) Notice: Subject to any disclaimer, the term of this patent is extended or adjusted under 35 U.S.C. 154(b) by 0 days.

(21) Appl. No.: 11/548,913

(22) Filed: Oct. 12, 2006

(65) Prior Publication Data

US 2008/0012418 A1 Jan. 17, 2008

(30) Foreign Application Priority Data

Oct. 12, 2005 (DE) ..... 10 205 049 317

(51) Int. Cl.
*E21C 27/32* (2006.01)

(52) U.S. Cl. ..... 299/34.09

(58) Field of Classification Search ..... 299/34.04, 299/34.09

See application file for complete search history.

(56) References Cited

U.S. PATENT DOCUMENTS 2,823,908 A * 2/1958 Rosler ..... 299/34.09
4,159,849 A * 7/1979 Rehbein ..... 299/34.09
4,583,785 A * 4/1986 Breuer et al. ..... 299/34.09

FOREIGN PATENT DOCUMENTS

DE 31 06 548 A1 9/1982

* cited by examiner

*Primary Examiner*—John Kreck
(74) *Attorney, Agent, or Firm*—Baker & McKenzie LLP

(57) ABSTRACT

A baseplate plow with a multipart baseplate including a middle baseplate part connected to a plow body and two outer baseplate parts connected movably to the middle baseplate part. Guide blocks at a packing-side end of each baseplate part guide the baseplate in chain guide channels. Two chain blocks for connecting the plow pull chain are formed on a push member which is inserted into a recess at the packing-side end of the middle baseplate part, the recess being delimited in each of two running directions of the baseplate plow by a block part including a guide block and a stop surface for the push member.

16 Claims, 3 Drawing Sheets

PLOW BASEPLATE

CROSS-REFERENCE TO RELATED APPLICATION

This application claims priority of German Patent Application No. 102005049317.3

BACKGROUND OF THE INVENTION

The invention relates to a baseplate plow with a multipart baseplate which consists of a middle baseplate part fixedly connected to a plow body and of two outer baseplate parts connected movably thereto, with guide blocks at the packing-side end of each baseplate part for guiding the baseplate in chain guide channels for a plow chain, and with at least one chain block, cooperating with the baseplate, for each running direction of the baseplate plow, for the connection of the plow pull chain.

A generic baseplate plow is known from DE 31 06 548 A1. In baseplate plows, the plow baseplate engages under a conveyor, such as, in particular, a chain scraper conveyor, having the plow and chain guides on the packing side, and the plow chain is guided at the rear end of the baseplate, consequently on the packing side, in chain guide channels which are mounted on the conveyor. By means of baseplate plows, coal can be mined economically, particularly in the case of a low thickness of he seams to be mined, since, even with thicknesses of less than 600 mm, the plow pull chain remains accessible on the packing side of the conveyor. In the generic baseplate plow, which is offered by the applicant under the tradename "Reisshaken" ["tearing hook"], the plow chain is fastened in each case to chain blocks which are formed on guide blocks of the two outer baseplate parts. The outer baseplate parts are connected to the middle baseplate part via a packing-side articulated coupling formed from chain links, the eyes of the chain links engaging in each case into hook-shaped coupling pieces or blocks which are formed, on the one hand, on the guide blocks of the outer articulated plates and, on the other hand, on guide blocks of the middle baseplate part. Each coupling hook is assigned a securing piece by means of which the associated chain link is secured to this coupling hook. The joint formed by the chain links admittedly allows good pivoting movability between the outer baseplate parts and the middle baseplate part. However, an exchange of the chain links forming the packing-side articulated connection between the baseplate parts and also the connection of the plow pull chain to the chain blocks are complicated and mean comparatively long standstill times of the generic baseplate plow.

The object of the invention is to provide a baseplate plow which allows a quickly and easily executable connection or exchange of the plow pull chain or of the packing-side articulated coupling between the baseplate parts and, moreover, has a markedly improved running behavior, along with an advantageous transmission of the high pull forces of the driven plow chain on the baseplate plow.

BRIEF SUMMARY OF THE INVENTION

This and further objects are achieved, according to the invention, in that the two chain blocks are formed on a push member which is inserted or insertable into a recess exchangeably at the rear or packing-side end of the middle baseplate part, said recess being delimited in each of the two running directions of the baseplate plow by a block part forming a rigid component of the middle baseplate part which is provided with a guide block and which has a stop surface for the push member. In the baseplate plow according to the invention, the push member having the chain blocks and running in the chain guide channels of a plow guide arranged on the packing side of a conveying trough is an exchange part which can be exchanged, complete with the two chain blocks, in the event of wear. At the same time, in the baseplate plow according to the invention, force transmission no longer takes place to the outer baseplate parts by a pulling action, but, instead, the push member cooperates with the middle baseplate part with a pushing action, so that the plough is driven by the plow pull chain essentially in a pushing action instead of a pulling action. By the push member exerting a pushing action on the middle baseplate part and consequently on the plow body, the running behavior of the baseplate plow is improved considerably. In this case, it is of further advantage that the outer baseplate parts which, in the running direction of the baseplate plow, in each case lead the middle baseplate part loaded by the pushing forces are also no longer acted upon by the forces of the plow pull chain directly, but only indirectly.

According to a particularly preferred refinement, the push member has on the two pushing surfaces pointing in the running direction, and so as to be spaced apart from the chain blocks or guide blocks arranged on the packing side, a projecting tenon which fits into an indentation, formed so as again to be spaced apart from the guide block, on the respective block part. As a result of the interaction of the tenons, preferably provided with rectangular cross sections, and indentations, the push member can be secured positively or essentially positively in the recess against creeping out laterally. Preferably, further, the push member is supported toward the open bottom of the recess by means of at least one projection projecting into the recess. By means of a, for example, central projection, but preferably by means of two projections spaced apart from one another, the push member can be secured against creeping out of the recess downward, so that it is not subjected to excessive wear during the movement of the baseplate plow. The mounting of the push member in this case advantageously takes place from above, and the push member can be secured against creeping out upward by means of a suitable profile of the plow guide, in particular a packing-side lower conveyor profile. Upward retention consequently no longer takes place by means of a component on the baseplate of the baseplate plow. The baseplate can advantageously be designed in such a way that the middle baseplate part has a plate part to which the two block parts delimiting the recess and enclosing the latter between them are welded. The recess may in this case advantageously be open toward the packing side and toward the underside. Owing to the multipart welded configuration of the middle baseplate part with a plate part consisting of a metal sheet or the like and, if appropriate, with multiply stepped block parts, the individual components can be designed optimally in terms of their essential functioning both as regards shaping and as regards material selection. The projections for the bottom-side support of the push member in the recess can then be formed integrally or as a weld-on part on a longitudinal edge, formed by the plate part of the middle baseplate part, of the recess and can project into the latter.

Preferably, further, each outer baseplate part may be provided with a clearing block which, for example, formed integrally, has the associated guide block for this baseplate part. The clearing blocks on the two outer baseplate parts lead the respective block part of the middle baseplate part in the chain guide channels, so that said clearing blocks at the same time form wear protection for the block parts formed on the middle baseplate part. It is particularly advantageous in this case if the outer baseplate parts each have a plate part to which the associated clearing block is welded, so that the outer baseplate parts, too, may consist of different materials and/or of elements adapted optimally to their function. In a particularly advantageous refinement, the lateral edges of the plate parts of the middle baseplate part and of the outer baseplate part are then in each case designed with a curve at the connecting joint, preferably the lateral edges of the plate part of the middle baseplate part being provided with a concave curvature and the respective lateral edge of the plate parts of the outer baseplate parts being provided with a convex curvature. Interaction of the convex and concave curves of the lateral edges ensures a markedly smoother run of the baseplate plow and thus markedly reduces the noises and acoustic pollution caused by the baseplate. Furthermore, the plate part of the outer baseplate parts and the plate part of the middle baseplate part can in each case preferably be designed at the connecting joint without, but also with an overlap.

According to a particularly preferred refinement, the block parts and the clearing block parts have on their butting surfaces in each case alternately a projecting nose and a necking which engage one into the other for the alternate overlapping of the block part and clearing block. Owing to this refinement, an additional support of the outer baseplate parts movably in relation to the middle baseplate part is achieved, and the clearing capacity of the outer baseplate part which leads with regard to the respective running direction is improved.

Since the noses and neckings are formed on the block parts or clearing blocks, they can be dimensioned with correspondingly high strength. The chain blocks and the clearing blocks therefore preferably in each case project beyond the plate parts in height and/or are of stepped design.

In order to reduce the wear on the plow pull chain or on a chain gear connected to the chain block, the block parts and the clearing blocks may preferably be provided, further, on their rear side located on the packing side or facing the rear end, with reception pockets which allow a penetration of a leg of a horizontal chain link of the plow pull chain connected to the chain block or of a chain gear connected or connectable to the chain block.

According to a particularly advantageous refinement, the block parts and the clearing blocks are provided on their rear side located on the packing side or facing the rear end with pockets for the engagement of heads of connecting toggles. In the baseplate plow according to the invention, therefore, the packing-side articulated couplings between the outer baseplate parts and the middle baseplate part are no longer formed by a chain, but, instead, the articulated connection is brought about by means of a high-strength connecting toggle which is inserted into associated pockets on the baseplate parts. It is particularly advantageous if the connecting toggle used is identical to those connecting toggles by means of which the individual sections of a conveyor are connected, so that a separate or specially designed connecting toggle does not have to be kept in stock in the underground longwall for the baseplate plow. Use of the same connecting toggle for a conveyor and for the baseplate parts of a baseplate plow is of independent inventive significance.

The use of a push member having the two chain blocks has the further advantage that the chain links of a plow pull chain or of a chain gear which are suspended on the chain blocks can be secured by means of a single common securing piece capable of being fastened to the push member. The outlay in mounting terms thereby falls considerably, as compared with the prior art. According to a particularly advantageous refinement, the securing piece may have integrated into it a switching magnet which cooperates with switching contacts on the chain guide channels or a plow guide, in order, for example, as is known per se, to make it possible in the longwall end region to have signal detection of the time from when the plow pulling speed has to be lowered in order to prevent the baseplate plow from running at too high a speed into the drive frames of a chain conveyor. The integration of a switching magnet into a securing piece is also of independent inventive significance. It is particularly advantageous if the securing piece is fastened to the push member by means of shear bolts and screw bolts, so that it cannot be lost even in the event of a play of the screw bolts owing to the shear bolts.

Further advantages and refinements of a baseplate plow according to the invention may be gathered from the following description of an exemplary embodiment shown diagrammatically in the drawing in which:

DETAILED DESCRIPTION

Figures 1, 2, 3:
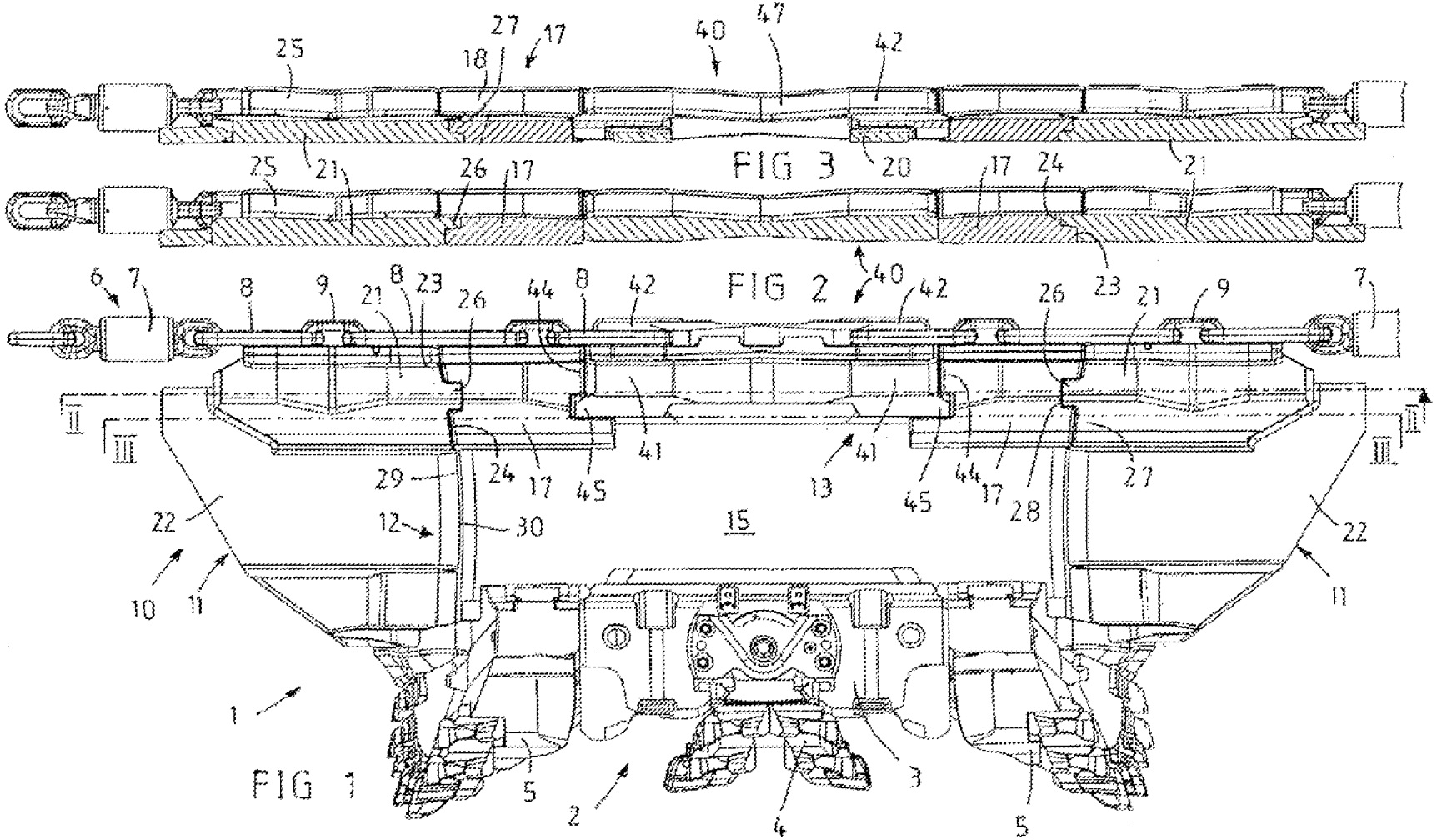
FIG. 1 shows a top view of a baseplate plow according to the invention with a mounted push member.
FIG. 2 shows a sectional view along II-II in FIG. 1.
FIG. 3 shows a sectional view along III-III in FIG. 1.

The baseplate plow 1 illustrated in FIG. 1, which can be used particularly in coal mining as a coal plow for seam thicknesses of less than 1.5 m and possibly less than 0.6 m, is designed as a baseplate plow comprising a multipart plow baseplate 10 constructed symmetrically with respect to the running direction of the baseplate plow 1 and having two outer baseplate parts 11 and a middle baseplate part 12, by means of which the coal plow 1 can be guided on a longwall conveyor, not illustrated, which may be designed particularly as a chain scraper conveyor. The plow body 2 loosening the rock, such as, particularly, coal, to be mined at the working face consists of a middle plow body 3, which is fastened, in particular welded, rigidly to the middle baseplate part 12 and which is provided with a roof cutter carrier 4 of adjustable height and of two lateral cutter carriers 5 which are articulated in each case pivotably on the plow body 3 and of which, depending on the running direction of the baseplate plow 1, as a result of the pivoting of the two cutter carriers in opposite directions, in each case only one is in operational use, while the other is pivoted into a position in which it does not perform any mining work in the respective plow running direction. The two outer baseplate parts 11 are connected in an articulated manner to the two cutter carriers 5 pivotable in relation to the plow body 3 and therefore also in relation to the middle baseplate part 12. The two outer baseplate parts 11 are therefore mounted, overall, pivotally movably in relation to the middle baseplate part 12. The construction of the cutter carriers 5, of the plow body 3 and of the roof cutter carrier 4 and also the pivotable fastening of the outer baseplate parts 11 to the cutter carriers 5 are not dealt with any further here, since these are not the subject of the present invention.

Figure 4:
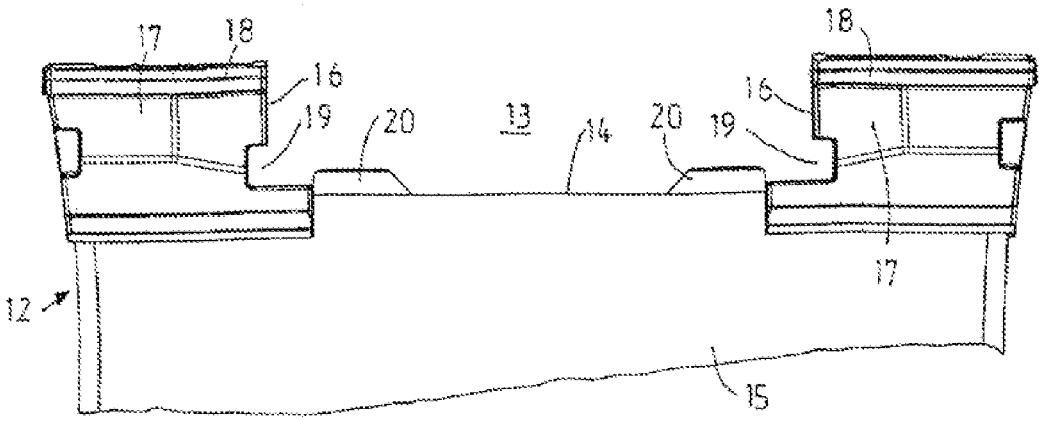
FIG. 4 shows a top view of the rear packing-side end of the middle baseplate part with the recess.
Figure 6:
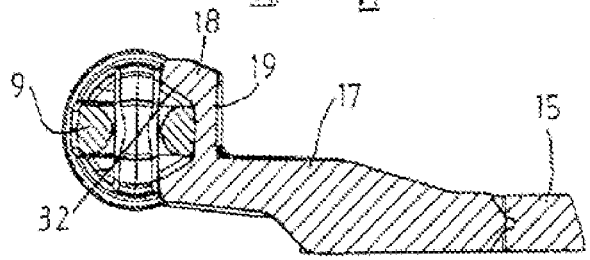
FIG. 6 shows a sectional view along VI-VI in FIG. 5.

According to the invention, the middle baseplate part 12 of the plow baseplate 10 is provided at the packing-side and with a recess 13 open toward the packing side, as can best be seen from FIG 4. In this context, the packing side refers to the operational use of the baseplate plow 1 according to the invention, in which the cutters of the plow body 2 slide along the working face and, as mining progresses, the entire mining plant is pushed forward in the direction of the working face. The side facing the working face forms the working face side and the opposite side forms the packing side on which packing rock recloses the longwall space previously mined and kept open by means of support frameworks, as is known to a person skilled in underground mining. The recess 13 at the packing-side end of the middle baseplate part 12 is in this case delimited, on the one hand, on the working face-side longitudinal side, by the lateral edge 14 of a plate part 15 consisting of a metal sheet and, transversely thereto, in the two running directions of the baseplate plow 10, by stop surfaces 16 which are formed on block parts 17 and which face the recess 13, are designed mirror-symmetrically with respect to one another and are welded, spaced apart from one another, to the plate part 15. As is evident particularly from FIGS. 2, 3 and 6, the two block parts 17 are in this case of stepped design and are provided integrally on the packing side with a guide block 18 which, in particular, is guided with its front surface 19 facing the working face on a guide profile, not illustrated, of a chain scraper conveyor or of a plow guide or the like.

Figure 5:
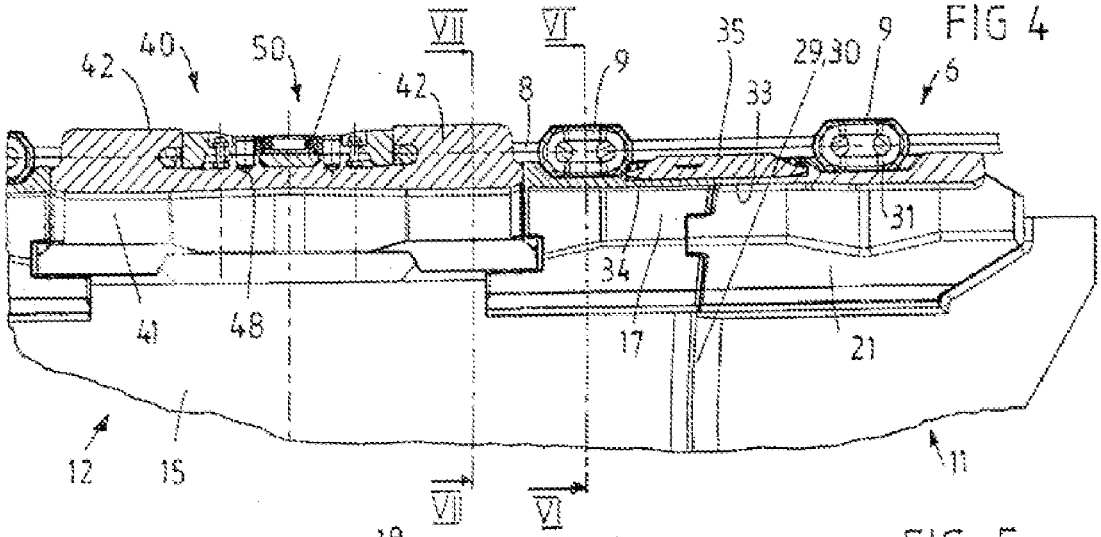
FIG. 5 shows a partially cut away view of the detail of the packing-side end of the baseplate according to FIG. 1.

The movement of the baseplate plow 10 in the respective running direction is brought about via a plow pull chain, designated in the figures by reference symbol 6, which is driven in one direction or the other by means of two plow drives (not shown) connected to the longwall ends. In the illustrated exemplary embodiment of the plow chain 6, there is a plow chain string in each case with a chain sprocket 7 for each running direction, with a plurality of vertical chain links 8 of different lengths, which are designed as special chain links in comparison with the chain links of a normal plow chain 6, and with a plurality of horizontal chain links 9 which may also be the standard chain links of the plow chain. Force transmission from the plow chain 6 to the baseplate plow 10 takes place, according to the invention, by means of a push member 40 which is inserted into the recess 13 in the middle baseplate part 12 and which is provided with two chain blocks 41 having hook-shaped extensions 42, as shown particularly in FIGS. 1 and 5. The chain blocks 41, preferably formed integrally on the push member 40 consisting of a casting or forging, have a stepped construction in a similar way to the block parts 17 on the middle baseplate part 14, and in this case the front surface 43 of guide blocks 47 formed on the chain blocks 41 may again serve for guidance on a profile of a chain scraper conveyor, not illustrated.

Figure 7:
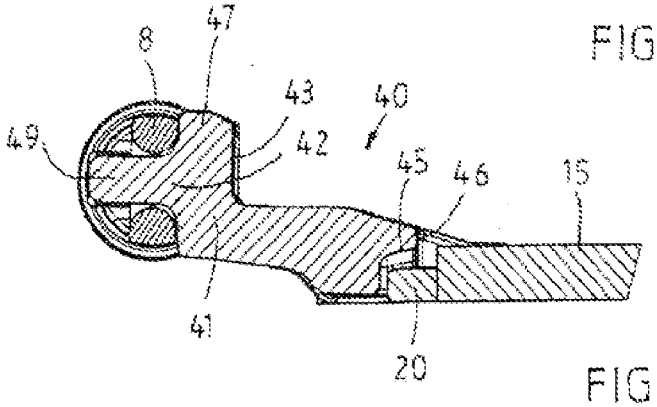
FIG. 7 shows a sectional view along VII-VII in FIG. 5.

The push member 40, designed with high strength and rising to the same height as the block parts 17, is provided on the two pushing surfaces 44 pointing in the running direction with a tenon 45 which projects beyond these pushing surfaces and which, in the mounted state, fits into an associated indentation 19 in the block parts 17, so that the push member 40 is secured positively in the recess 13 against creeping out laterally. The two indentations 19 are in this case located at a distance from the guide blocks 18 of the block parts 17 and adjacently to the lateral edge 14 of the plate 15. The rectangular tenons 45 on the chain blocks 41 of the push member 40 are also formed at a corresponding distance. To support the push member 40 in the downwardly open recess 13, at the lateral edge 14 of the plate part 15 two projections 20 project, on which the push member 40 is supported via an inner step 45 on the working face-side wall surface 46 of the push member 40, as shown particularly in FIG. 7. The projections 20 may likewise have an essentially rectangular cross section and be formed integrally or welded on the plate part 15. In the mounted state, a push member 40 inserted into the recess 13 is held upwardly by the guide strip cooperating with the guide blocks 47 and 18 against creeping out during the running movement of the baseplate plow. The forces introduced into the push member 40 by means of the plow pull chain 6 are introduced into the middle baseplate part 12 of the plow baseplate and consequently into the baseplate plow solely by a pushing action via the stop surface 44 on the push member 40 and the bearing surface 16 on the respective block part 17.

Reference is again made, then, to FIGS. 1 to 3. The outer baseplate parts 11 are connected in each case pivotally movably to the middle baseplate part 12. For this purpose, the outer baseplate parts 11 are supported on the working face side on the cutter carriers 5 via tenons, not illustrated. The transmission of the forces introduced by the push member 40 into the middle baseplate part 12 to the outer baseplate parts 11, so that these lead the middle baseplate part 12 in the respective running direction essentially with a clearing effect, takes place essentially via clearing blocks 21 which are welded on the packing side to plate parts 22 of the outer baseplate parts 11. The clearing blocks 21 rise essentially to the same height as the block parts 17 above the respective plate parts 22 and 15, so that the force transmission can take place via sufficiently wide butting surfaces 23 on the block parts 17 and butting surfaces 24 on the clearing blocks 21. As shown particularly in FIGS. 2 and 3, the two clearing blocks 21 are also provided with upright guide blocks 25, in order also to guide the outer baseplate parts 11 on a guide profile of a chain scraper conveyor or the like, and the clearing blocks 21 and block parts 17 overlap one another alternately at the butting surfaces 23 and 24 by means of projecting noses 26 and edges 27 on the respective butting surfaces 23 and 24. The noses on the clearing blocks 21, which fit into neckings 28 on the butting surface 23 of the block part 17, again at the same time ensure a lateral support of the clearing blocks 21 and consequently of the outer baseplate parts 11 in relation to the middle baseplate part 12. The noses 26 consequently fulfill a double function here, to be precise, on the one hand, support in the vertical direction and, at the same time, lateral support.

The plate part 15 of the middle baseplate part 12 has concavely curved lateral edges 30 pointing in the running direction, and the adjacent lateral edges 29 of the plate parts 22 of the outer baseplate parts 11 are curved convexly and without overlap with the lateral edges 30, in order to minimize the traveling noises of the baseplate plow 1.

As already mentioned further above, a horizontal chain link 8 of the plow chain 6 is laid around a hook-shaped extension 42 on the chain block 41 of the push member 40. As shown particularly in the top view in FIG. 1, the vertical chain links 8 in each case bear directly on the rear side of the push member 40, of the block part 17 of the middle baseplate part 12 and of the clearing block 21 of the outer baseplate parts 11. As shown particularly in FIGS. 5 and 6, in each case the vertical chain links 9 penetrate with a chain link leg into depressions 32 in the packing-side rear side of the chain blocks 17 (FIG. 6) or into depressions 31 in the rear side of the clearing blocks, without forces being transmitted to the block parts 17 or the clearing blocks 21 by the horizontal chain links 9 or the vertical chain links 8 connecting these. However, the block parts 17 and the clearing blocks 21 are connected in the running direction by means of connecting toggles 35 which engage into associated reception pockets 33 and 34 which are formed in the rear side of the clearing blocks 21 and of the block parts 17.

Figure 8:
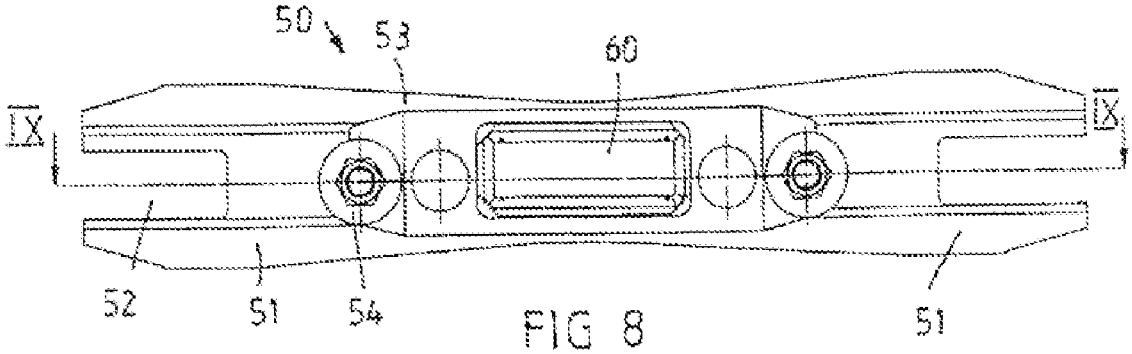
FIG. 8 shows a top view of the securing piece for securing the chain links on the chain blocks.
Figure 9:
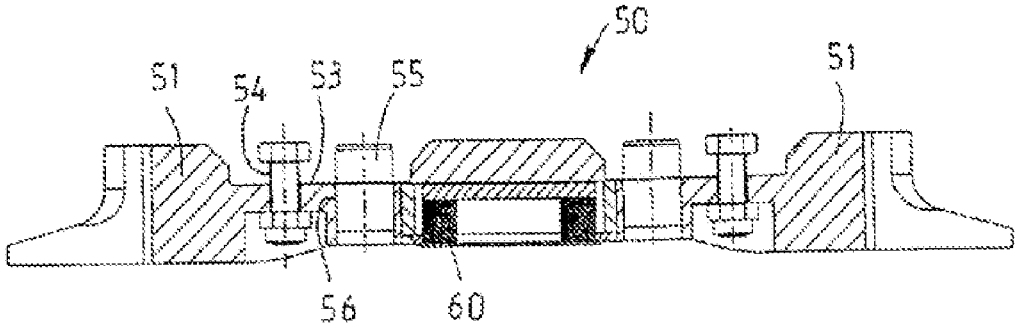
FIG. 9 shows a sectional view through the securing piece from FIG. 8 along IX-IX in FIG. 8.

A securing piece 50, illustrated in detail in FIGS. 8 and 9, which is fastened to the push member 40 serves for retaining the vertical chain links 8 laid around the hook-shaped extensions 42 on the chain blocks 41 of the push member 40. The securing piece 50 comprises two fork-shaped ends 51 with clearances 52, into which in each case a nose of the vertical chain link fixed to the chain block can penetrate, so that the two string ends of the plow pull chain are fixed to the push member by means of a single securing piece 50. The retention of the securing piece 50 on the push member takes place by means of two fastening bolts 54 which pass through two bores in a middle piece 53 of the securing piece 50 and which can be fixed in a suitable way in pocket grooves on the push member. So as still to hold the securing piece 50 in its securing position on the push member even in the event of a loosening of the fastening bolts 54, two shear bolts 55 are provided, which pass through bores 56 in the middle piece 53 and fit into suitable depressions 48 (FIG. 5) in the push member (40, FIG. 5). As a further particular feature according to the invention which has independent inventive significance, the middle part 53 of the securing piece 50 has integrated into it a switching magnet 60 which cooperates with corresponding switching contacts on the trough sections or plow guide sections, so that, for example, the positions of the baseplate plow can be detected or a run of the baseplate plow into the longwall end region can be indicated.

Numerous modifications which are to come within the scope of protection of the appended claims may be gathered from the foregoing description by a person skilled in the art. The configuration of the chain links may also take place differently. The geometry of the recess and of the respective guide blocks on the block parts, clearing blocks and chain blocks may also be adapted to the contour and position of a respective conveyor-side guide strip.

The invention claimed is:

1. A baseplate plow with a multipart baseplate, comprising:

a plow body;

a plow pull chain including at least one link;

a middle baseplate part attached to the plow body;

a recess located on a packing-side end of the middle baseplate part;

a push member located in the recess, the push member including at least one pushing surface;

at least one chain block located on the push member and operable for connection to the plow pull chain;

a first block part rigidly connected to the middle baseplate part at a first edge of the recess, the first block part including a stop surface;

a second block part rigidly connected to the middle baseplate part at a second edge of the recess, the second block part including a stop surface;

a first guide block located on the first block part; and a second guide block located on the second block part, wherein the stop surface of each of the first block part and the second block part is positioned in contact with the push member.

2. The baseplate plow of claim 1, further comprising:

at least one indentation located in each of the first block part and the second block part; and at least one projecting tenon located on the at least one pushing surface of the push member, wherein the at least one projecting tenon is located within the at least one indentation.

3. The baseplate plow of claim 1, further comprising at least one projection located in the recess, the at least one projection operable for supporting the push member.

4. The baseplate plow of claim 3, further comprising a middle plate part located on the middle baseplate part, wherein each of the first block part and the second block part is attached to the middle plate part.

5. The baseplate plow of claim 4, wherein the at least one projection is located on the middle plate part.

6. The baseplate plow of claim 1, further comprising:

a first outer baseplate part attached to the middle baseplate part;

a second outer baseplate part attached to the middle baseplate part;

a first outer clearing block located on the first outer baseplate part;

a first outer guide block located on the first outer clearing block;

a second outer clearing block located on the second outer baseplate part; and a second outer guide block locate on the second outer clearing block.

7. The baseplate plow of claim 6, further comprising:

a first outer plate part located on the first outer baseplate part; and a second outer plate part located on the second outer plate part, wherein the first outer clearing block is attached to the first outer plate part; and the second outer clearing block is attached to the second outer plate part.

8. The baseplate plow of claim 7, wherein each of the middle plate part, the first outer plate part, and the second outer plate part include curved lateral edges.

9. The baseplate plow of claim 8, wherein the middle plate part is located adjacent to the first outer plate part and the second outer plate part at connecting joints; and the connecting joints include an overlap.

10. The baseplate plow of claim 6, wherein each of the first outer clearing block and the second outer clearing block include a projecting nose;

each of the first block part and the second block part include a necking element;

the projecting nose of the first outer clearing block is engaged with the necking element of the first block part; and the projecting nose of the second outer clearing block is engaged with the necking element of the second block part.

11. The baseplate plow of claim 6, wherein at least one of a height of each of the first block part and the second block part is greater than a height of the respective plate part or the first block part and the second block part include a step; and at least one of a height of each of the first outer clearing block and the second outer clearing block is greater than a height of the respective plate part or the first outer clearing block and the second outer clearing block include a step.

12. The baseplate plow of claim 6, further comprising a chain gear connectable to the chain block, the chain gear including at least one link, wherein each of the first block part and the second block part and each of the first outer clearing block and second outer clearing block include a depression operable for locating a horizontal chain link of the chain gear.

13. The baseplate plow of claim 6, further comprising a connecting toggle including a head, wherein each of the first block part and the second block part and each of the first outer clearing block and the second outer clearing block include at least one pocket operable for engagement of the head of the connecting toggle.

14. The baseplate plow of claim 12, further comprising at least one securing piece, the at least one securing piece being fastened to the push member, wherein the at least one links of the plow pull chain or the at least one link of the chain gear are suspended on the chain blocks and are secured to the push member by the securing piece.

15. The baseplate plow of claim 14, further comprising a switching magnet integrated into the securing piece.

16. The baseplate plow of claim 15, wherein the securing piece is fastened to the push member by at least one of shear bolts or screw bolts.

* * * * *